US005682939A

United States Patent [19]

Vargo

[11] Patent Number: 5,682,939

[45] Date of Patent: Nov. 4, 1997

[54] WINDOW SHADE SYSTEM

[76] Inventor: Joette A. Vargo, 414 Southview Dr., Lititz, Pa. 17543

[21] Appl. No.: 644,623

[22] Filed: May 6, 1996

[51] Int. Cl.[6] ..... A47H 23/00

[52] U.S. Cl. ..... 160/237; 160/121.1

[58] Field of Search ..... 160/237, 238, 160/120, 121.1, 122, 123, 124, 126, 330, 264, 354, 25, 385, 386, 387, 390

[56] References Cited

U.S. PATENT DOCUMENTS

| | | | |
|---|---|---|---|
| 276,152 | 4/1883 | Barricklo | 160/237 X |
| 1,997,484 | 4/1935 | Collins | 160/237 X |
| 2,351,373 | 6/1944 | Thexton | 160/238 |
| 2,500,074 | 3/1950 | Hill | 160/123 |
| 2,587,492 | 2/1952 | Lipetz | 160/124 |
| 3,035,275 | 5/1962 | Strebeigh | 160/237 X |
| 3,186,474 | 6/1965 | Levitas | 160/238 |
| 3,205,118 | 9/1965 | Guffan | 160/238 |
| 4,907,636 | 3/1990 | Simon | 160/238 |
| 5,203,395 | 4/1993 | Koller et al. | 160/121.1 X |

*Primary Examiner*—David M. Purol

[57] ABSTRACT

A new Window Shade System for offering a system of window shades that send a message or illustrates an ornamental image. The inventive device includes a shade attachment with an attachment arrangement, a first thickness, a second thickness, an intermediate thickness, and a fold edging. In use, the attachment arrangement is installed on the shade attachment 16 and the existing window shade 20. An intermediate thickness 34 is placed between the first thickness 30 and the second thickness 32 to give a desired color. The shade attachment 16 is then place upon the existing window shade 20 and the lights in the dwelling illuminate the message image 14 that is included within the shade attachment 16.

5 Claims, 3 Drawing Sheets

FIG 1
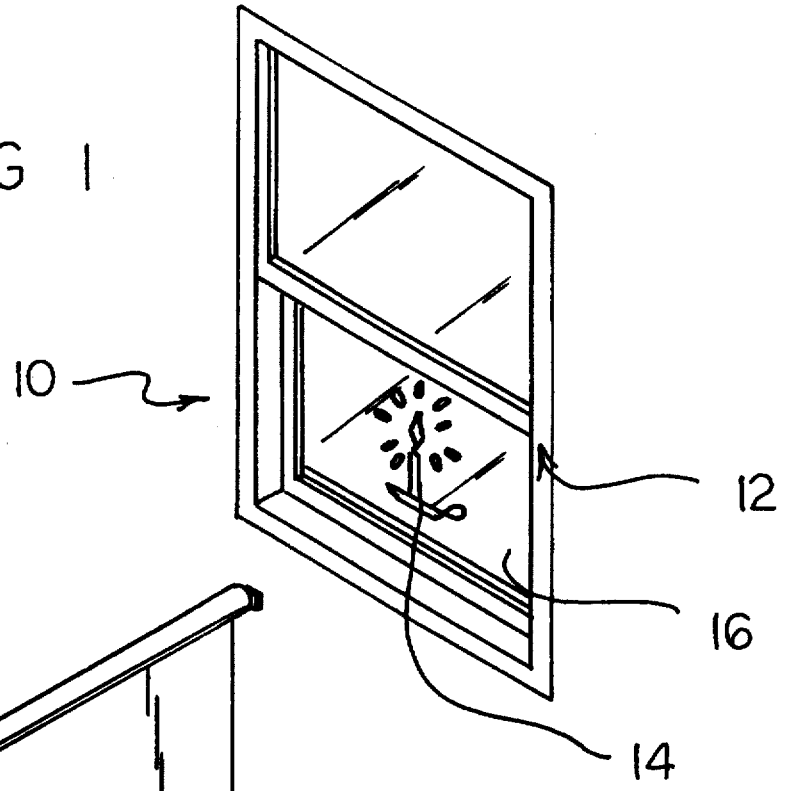
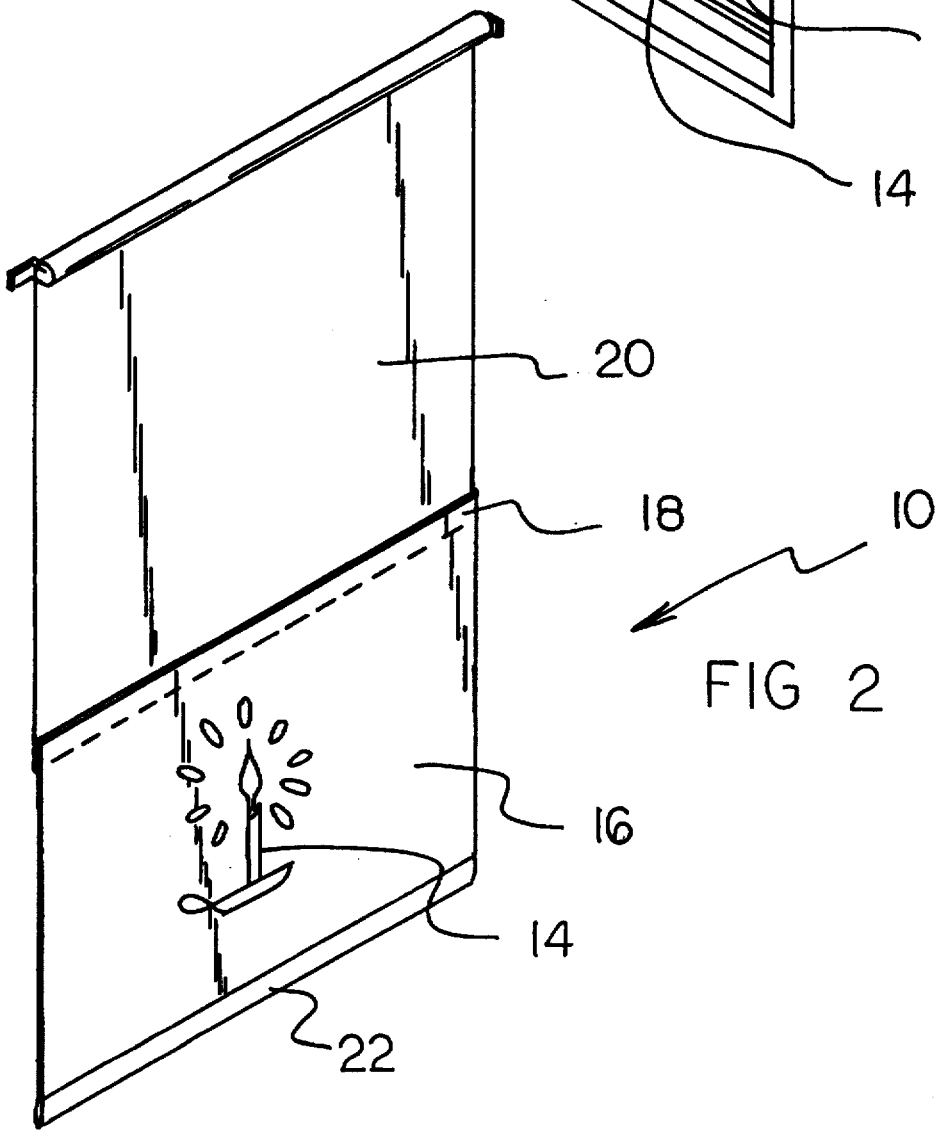
FIG 2

20

34
18
16
18
32
14
30
24
22
24
22

WINDOW SHADE SYSTEM

BACKGROUND OF THE INVENTION

1. Field of the Invention

The present invention relates to window signs and messages and more particularly pertains to a new Window Shade System for offering a system of window shades that send a message or illustrates an ornamental image.

2. Description of the Prior Art

The use of window signs and messages is known in the prior art. More specifically, window signs and messages heretofore devised and utilized are known to consist basically of familiar, expected and obvious structural configurations, notwithstanding the myriad of designs encompassed by the crowded prior art which have been developed for the fulfillment of countless objectives and requirements.

Known prior art window signs and messages include U.S. Pat. No. 5,400,848; U.S. Pat. No. 4,907,636; U.S. Pat. No. 5,203,395; U.S. Patent 5,098,149; U.S. Pat. No. 4,102,385; and U.S. Pat. Des. No. 353,737.

While these devices fulfill their respective, particular objectives and requirements, the aforementioned patents do not disclose a new Window Shade System. The inventive device includes a shade attachment with an attachment means, a first thickness, a second thickness, an intermediate thickness, and a fold edging.

In these respects, the Window Shade System according to the present invention substantially departs from the conventional concepts and designs of the prior art, and in so doing provides an apparatus primarily developed for the purpose of offering a system of window shades that send a message or illustrates an ornamental image.

SUMMARY OF THE INVENTION

In view of the foregoing disadvantages inherent in the known types of window signs and messages now present in the prior art, the present invention provides a new Window Shade System construction wherein the same can be utilized for offering a system of window shades that send a message or illustrates an ornamental image.

The general purpose of the present invention, which will be described subsequently in greater detail, is to provide a new Window Shade System apparatus and method which has many of the advantages of the window signs and messages mentioned heretofore and many novel features that result in a new Window Shade System which is not anticipated, rendered obvious, suggested, or even implied by any of the prior art window signs and messages, either alone or in any combination thereof.

To attain this, the present invention generally comprises a shade attachment with an attachment means, a first thickness, a second thickness, an intermediate thickness, and a fold edging.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Window Shade System apparatus and method which has many of the advantages of the window signs and messages mentioned heretofore and many novel features that result in a new Window Shade System which is not anticipated, rendered obvious, suggested, or even implied by any of the prior art window signs and messages, either alone or in any combination thereof.

It is another object of the present invention to provide a new Window Shade System which may be easily and efficiently manufactured and marketed.

It is a further object of the present invention to provide a new Window Shade System which is of a durable and reliable construction.

An even further object of the present invention is to provide a new Window Shade System which is susceptible of a low cost of manufacture with regard to both materials and labor, and which accordingly is then susceptible of low prices of sale to the consuming public, thereby making such Window Shade System economically available to the buying public.

Still yet another object of the present invention is to provide a new Window Shade System which provides in the apparatuses and methods of the prior art some of the advantages thereof, while simultaneously overcoming some of the disadvantages normally associated therewith.

Still another object of the present invention is to provide a new Window Shade System for offering a system of window shades that send a message or illustrates an ornamental image.

Yet another object of the present invention is to provide a new Window Shade System which includes a shade attachment with an attachment means, a first thickness, a second thickness, an intermediate thickness, and a fold edging.

Still yet another object of the present invention is to provide a new Window Shade System that provides an ability to quickly change decorations on a window.

Even still another object of the present invention is to provide a new Window Shade System that illuminates a sign or image and draws attention to a window.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front perspective view of a new Window Shade System according to the present invention.

FIG. 2 is an enlarged front perspective view thereof.

DESCRIPTION OF THE PREFERRED EMBODIMENT

Figure 3:
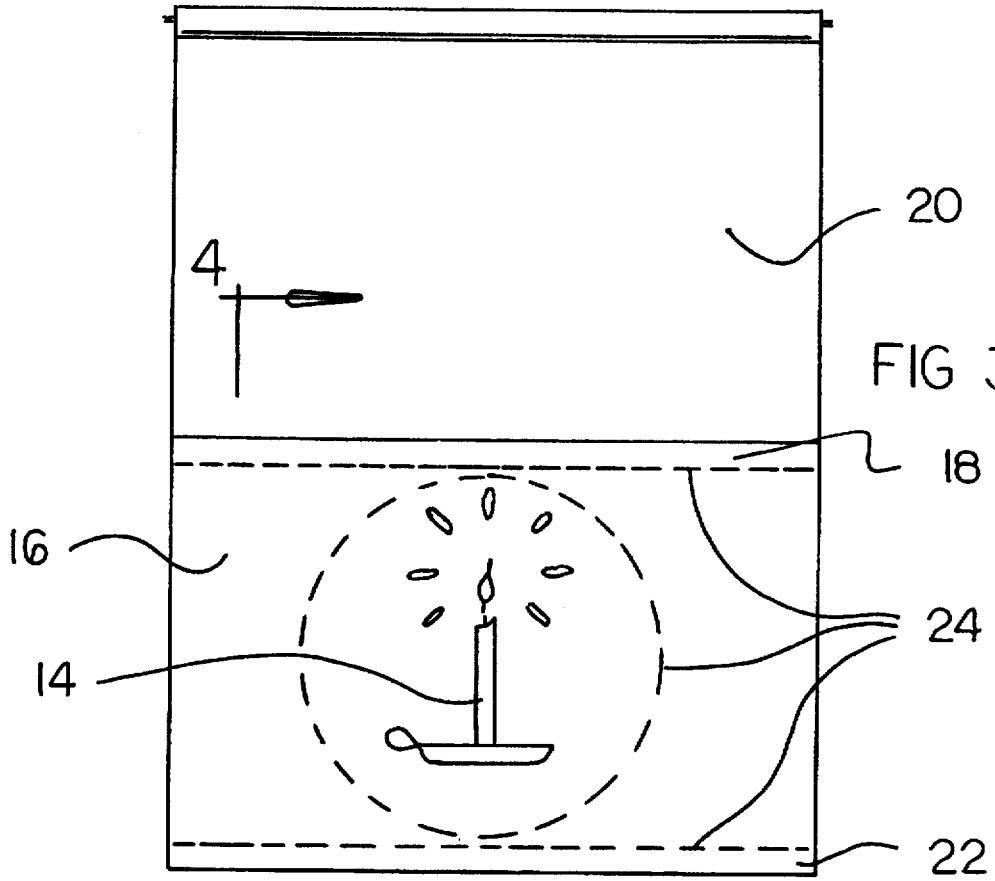
FIG. 3 is a front elevation view of the present invention.
Figure 4:
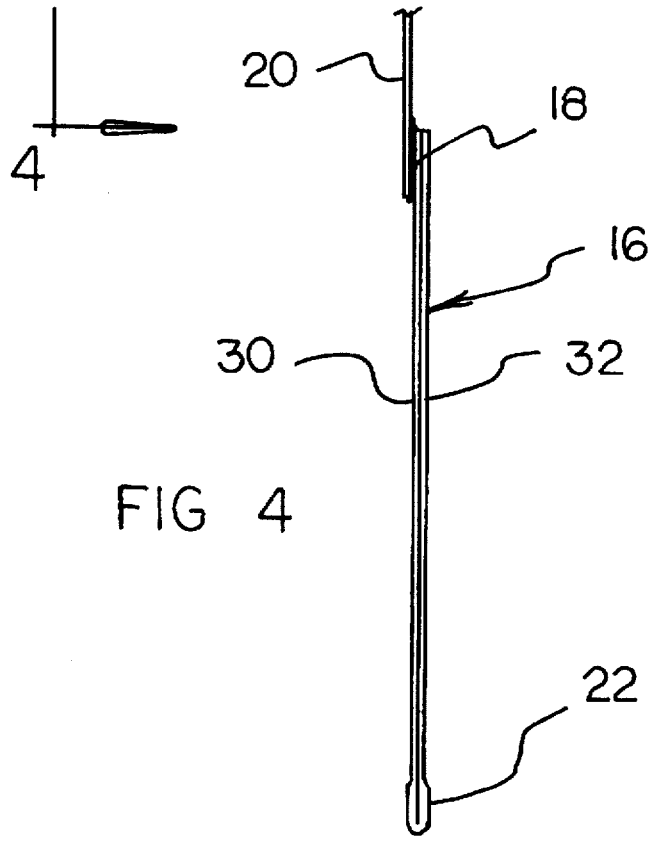
FIG. 4 is a cross sectional view taken along line 4—4 of FIG. 3.

With reference now to the drawings, and in particular to FIGS. 1 through 5 thereof, a new Window Shade System embodying the principles and concepts of the present invention and generally designated by the reference numeral 10 will be described.

More specifically, it will be noted that the Window Shade System 10 comprises a shade attachment 16 with an attachment means 18, a first thickness 30, a second thickness 32, an intermediate thickness 34, and a fold edging 22. The shade attachment 16 is a continuous material that when folded comprises the first thickness 30 and the second thickness 32. The fold is further defined by the fold edging 22.

As best illustrated in FIGS. 1 through 5, it can be shown that the window 12 with an existing window shade 20 is equipped with a portion of an attachment means 18 that mates with another portion of the attachment means 18 which is fixed to the shade attachment 16. The shade attachment 16 further comprises a message image 14 imbedded within it.

Figure 5:
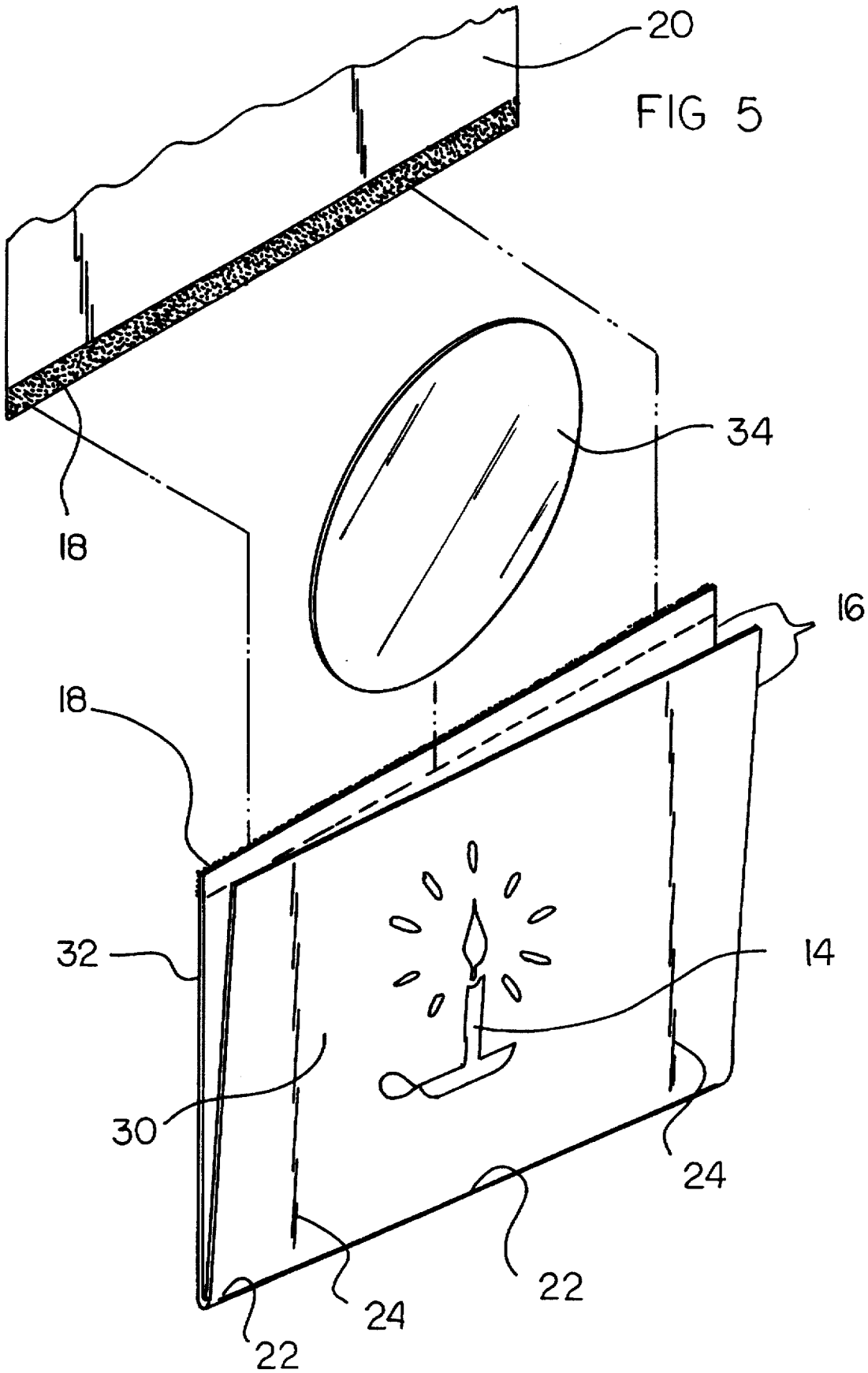
FIG. 5 is an exploded perspective illustration of the present invention.

Referring to FIG. 3 and 5, stitching lines 24 are added to the shade attachment 16 to give extra support and strength and to hold the intermediate thickness 34 in a desired position. In addition to this, the intermediate thickness 34 can have a variety of different colors to bring about a host of different results.

In use, the attachment means is installed on the shade attachment 16 and the existing window shade 20. An intermediate thickness 34 is placed between the first thickness 30 and the second thickness 32 to give a desired color. The shade attachment 16 is then place upon the existing window shade 20 and the lights in the dwelling illuminate the message image 14 that is included within the shade attachment 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Window Shade System comprising: a shade attachment for attachment to a window shade mounted on a window, said shade attachment comprising a substantially opaque first thickness of sheet material, a substantially opaque second thickness of sheet material coextensive with and secured to said first thickness, and an intermediate thickness of a substantially translucent material situated between said first and second thicknesses of sheet material; and a removable attachment means for removably attaching said shade attachment to the lower edge of a window shade mounted on a window in a depending relationship therefrom;

wherein said substantially opaque first and second thicknesses of said shade attachment have aligned portions of said sheet material thereof removed such that said substantially translucent intermediate thickness is exposed through said first and second thicknesses to permit light to pass through the intermediate thickness of said shade attachment and illuminate an image corresponding to said removed aligned portions.

2. The Window Shade System of claim 1, wherein the shade attachment comprises a continuous sheet of material folded over to form the first thickness and the second thickness of said shade attachment and wherein the fold in said continuous sheet material is covered by a fold edging for enhancing the grippability of said shade attachment.

3. The Window Shade System of claim 1, wherein said removable attachment means comprises a first and second portion, and wherein the first portion of said attachment means is mounted on said shade attachment and the second portion of said attachment means is attached to the lower edge of an existing window shade.

4. The Window Shade System of claim 1, wherein the intermediate thickness is smaller in area than said first and second thicknesses, and wherein said attachment means additionally comprises lines of stitched thread passing through said first and second thicknesses to hold the intermediate thickness in a desired position between said first and second thicknesses.

5. The Window Shade System of claim 1, wherein the substantially translucent intermediate thickness is colored to produce a coloring of the light passing therethrough.

* * * * *